US007814740B2

(12) United States Patent
Imanishi et al.

(10) Patent No.: US 7,814,740 B2
(45) Date of Patent: Oct. 19, 2010

(54) CORD FOR RUBBER REINFORCEMENT

(75) Inventors: Hideki Imanishi, Tokyo (JP); Mitsuharu Akiyama, Tokyo (JP); Hiroshi Iizuka, Yamagata (JP)

(73) Assignee: Nippon Sheet Glass Company, Limited, Tokyo (JP)

( * ) Notice: Subject to any disclaimer, the term of this patent is extended or adjusted under 35 U.S.C. 154(b) by 63 days.

(21) Appl. No.: 12/084,538

(22) PCT Filed: Nov. 8, 2006

(86) PCT No.: PCT/JP2006/322303

§ 371 (c)(1),
(2), (4) Date: Sep. 15, 2008

(87) PCT Pub. No.: WO2007/063686

PCT Pub. Date: Jun. 7, 2007

(65) Prior Publication Data

US 2009/0229237 A1 Sep. 17, 2009

(30) Foreign Application Priority Data

Nov. 9, 2005 (JP) ..... 2005-325305

(51) Int. Cl.
*D02G 3/02* (2006.01)

(52) U.S. Cl. ..... 57/210; 57/231

(58) Field of Classification Search ..... 57/210, 57/212, 218, 231

See application file for complete search history.

(56) References Cited

U.S. PATENT DOCUMENTS

| | | | | |
|---|---|---|---|---|
| 4,627,229 | A * | 12/1986 | Bourgois | 57/213 |
| 6,365,273 | B1 * | 4/2002 | Baillievier | 428/379 |
| 7,080,500 | B2 * | 7/2006 | Akiyama et al. | 57/212 |
| 2005/0091960 | A1 * | 5/2005 | Akiyama et al. | 57/222 |

FOREIGN PATENT DOCUMENTS

| | | | |
|---|---|---|---|
| JP | 2004-183121 | A | 7/2004 |
| WO | WO 2005/061766 | A1 | 7/2005 |

* cited by examiner

*Primary Examiner*—Shaun R Hurley
(74) *Attorney, Agent, or Firm*—Hamre, Schumann, Mueller & Larson, P.C.

(57) ABSTRACT

A cord for rubber reinforcement of the present invention includes a core strand including a plurality of strands (A), and a plurality of strands (B) disposed around the core strand. In the core strand, the plurality of strands (A) are finally twisted, and each of the plurality of strands (A) is formed of a plurality of reinforcing fibers (A) that are primarily twisted. Each of the plurality of strands (B) is formed of a plurality of reinforcing fibers (B) that are primarily twisted, and the plurality of strands (B) are finally twisted to be disposed around the core strand. The direction of final twist of the plurality of strands (B) is the same as the direction of primary twist in at least one strand (B) selected from the plurality of strands (B). The number of primary twists in the strand (B) is greater than the number of primary twists in the strand (A), and/or the number of final twists of the strands (B) is greater than the number of final twists of the strands (A).

3 Claims, 3 Drawing Sheets

CORD FOR RUBBER REINFORCEMENT

TECHNICAL FIELD

The present invention relates to a cord for rubber reinforcement.

BACKGROUND ART

Conventionally, cords for rubber reinforcement have been proposed.

For example, JP2001-114906A discloses a cord for rubber reinforcement that excels in bending fatigue resistance by the construction in which primary twist strands are used as a core member (inner layer) and a side member (outer layer).

JP2004-11076A discloses a cord for rubber reinforcement that excels in bending fatigue resistance and dimensional stability by the construction in which strands having different primary twist directions are used as a core member and a side member.

JP10 (1998)-141445A, JP9 (1997)-42382A, JP1 (1989)-213478A, and JP59 (1984)-19744A disclose cords for rubber reinforcement in which the number of primary twists and final twists of strands is limited to improve bending fatigue resistance. Further, JP7 (1995)-144731A, JP10 (1998)-291618A, JP2005-8069A, and JP2005-22455A disclose cords for rubber reinforcement in which the number of twists and the direction of twist of the strands are limited.

A drawback of conventional cords for rubber reinforcement, however, is that, when the cord is bent, a shear force causes a crack in the adhesive layer (for example, RFL layer) that binds the primary twist threads in a cord and eventually destroys the cord from the point of cracking. In other words, the conventional cords for rubber reinforcement with the limited number of twists and the limited twist direction do not have sufficient bending fatigue resistance.

When the cord is bent repeatedly, the crack first occurs in the adhesive layer between the primary twist threads. The crack changes the overall balance of stress in the cord, creating strong stress that locally concentrates on each primary twist thread. The concentration of stress breaks the strands making up the primary twist threads and eventually destroys the entire cord.

One effective way to reduce the shear force acting on the adhesive layer is to increase the number of final twists. However, simply increasing the number of final twists produces a cord with poor dimensional stability that easily stretches, or leads to weak tensile strength.

DISCLOSURE OF THE INVENTION

The present invention was made in view of the foregoing conventional problems, and one object of the present invention is to provide a cord for rubber reinforcement that excels in bending fatigue resistance, without lowering dimensional stability.

In order to achieve the foregoing object, a first cord for rubber reinforcement of the present invention includes a core strand including a plurality of strands (A), and a plurality of strands (B) disposed around the core strands, each of the plurality of strands (A) being formed of a plurality of reinforcing fibers (A) that are primarily twisted and the plurality of strands (A) being finally twisted in the core strand, each of the plurality of strands (B) being formed of a plurality of reinforcing fibers (B) that are primarily twisted and the plurality of strands (B) being finally twisted to be disposed around the core strand. A first cord for rubber reinforcement of the present invention satisfies at least one configuration selected from (i) and (ii) below ((i) and/or (ii)).

(i) The direction of final twist of the plurality of strands (B) is the same as the direction of primary twist in at least one strand (B) selected from the plurality of strands (B), and the number of primary twists in the strand (B) is greater than the number of primary twists in the strand (A).

(ii) The direction of final twist of the plurality of strands (B) is the same as the direction of primary twist in at least one strand (B) selected from the plurality of strands (B), and the number of final twists of the strands (B) is greater than the number of final twists of the strands (A).

As used herein, the number of primary twists in the strand (A) refers to the number of primary twists in the strand (A) yet to be finally twisted. Further, the number of final twists of the strands (A) refers to the number of final twists of the strands (A) in the core strand after final twisting of the strands (A) and (B).

A second cord for rubber reinforcement of the present invention is a cord for rubber reinforcement including a single core fiber (a) and a plurality of strands (b) disposed around the core fiber (a), the core fiber (a) being twisted, and each of the plurality of strands (b) being formed of a plurality of reinforcing fibers (b) that are primarily twisted and the plurality of strands (b) being finally twisted to be disposed around the core fiber (a), the direction of final twist of the plurality of strands (b) being the same as the direction of primary twist in at least one strand (b) selected from the plurality of strands (b), and the number of primary twists in the strands (b) being greater than the number of twists of the core fiber (a).

As used herein, the number of twists of the core fiber (a) refers to not the number of twists before final twisting of the strands (b) but the number of twists of the core fiber (a) in the cord for rubber reinforcement after final twisting with the strands (b).

The present invention provides a cord for rubber reinforcement that excels in bending fatigue resistance, without lowering dimensional stability.

BEST MODE FOR CARRYING OUT THE INVENTION

Figure 1:
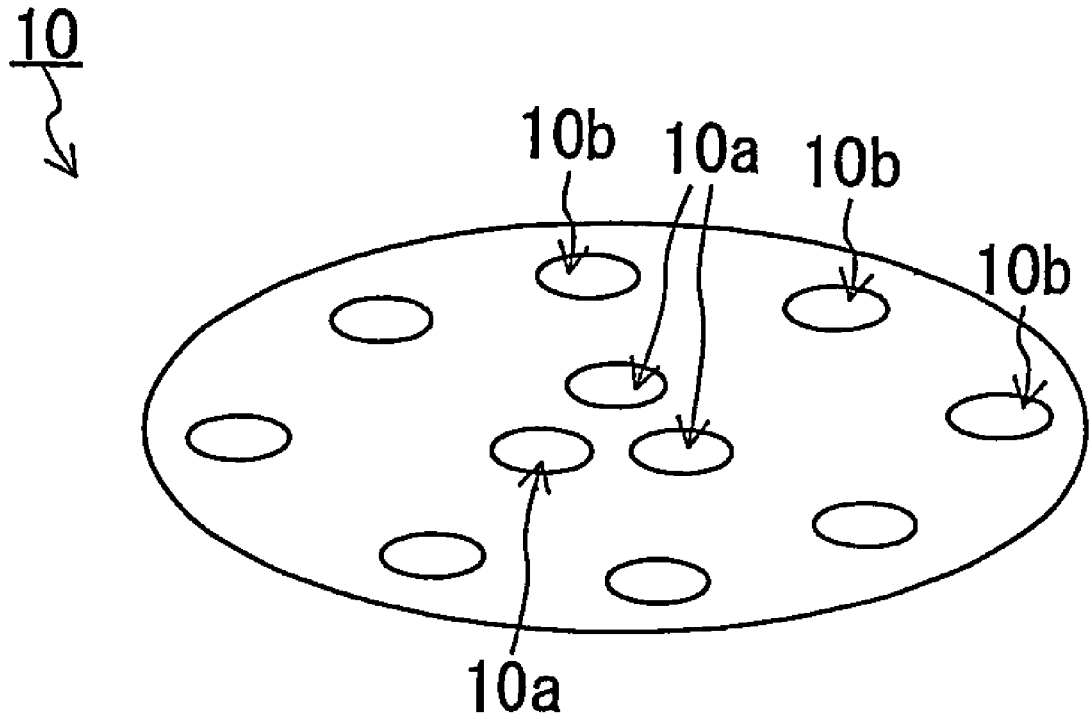
FIG. 1 is a diagram schematically showing an example of a guide used for manufacture of a cord for rubber reinforcement of the present invention.
Figure 2:
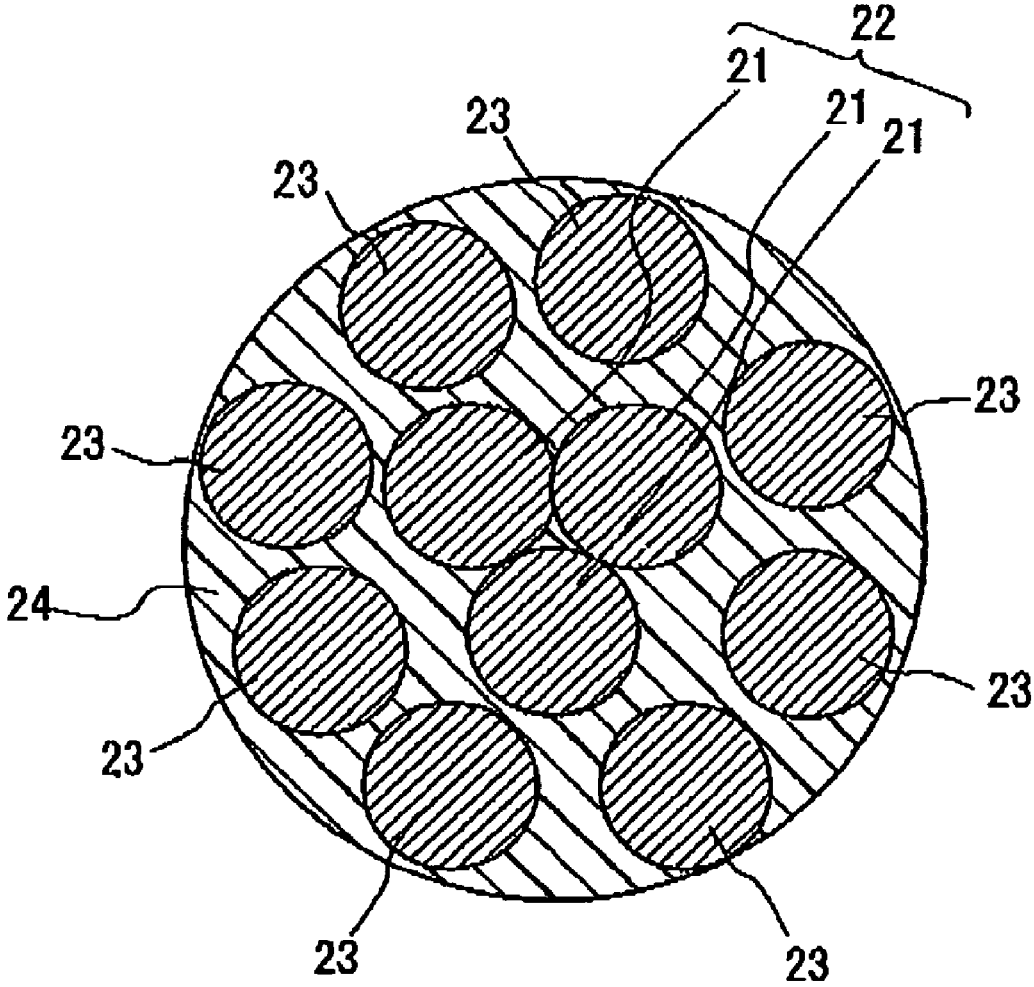
FIG. 2 is a cross sectional view showing schematically an example of a cord for rubber reinforcement, including strands (A) 21, core strands 22, strands (B) 23 and a coating film (overcoat layer) 24.
Figure 3:
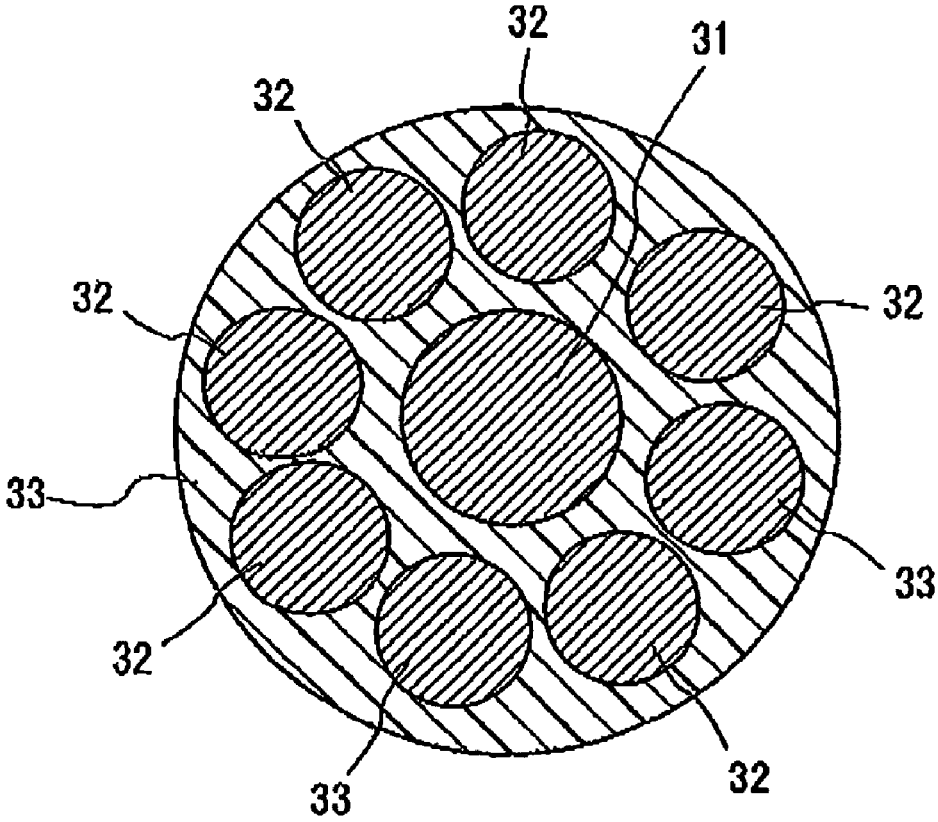
FIG. 3 is a cross sectional view showing schematically another example of a cord for rubber reinforcement, including a core fiber (a) 31, strands (b) 32 and a coating film (overcoat layer) 33.

The following will describe an embodiment of the present invention. It should be noted that the materials and dimensions described below are merely illustrative unless otherwise specified, and the present invention is not limited by the following description.

[First Cord for Rubber Reinforcement]

A first reinforcing cord of the present invention for rubber reinforcement includes a core strand including a plurality of strands (A), and a plurality of strands (B) disposed around the core strand. Each of the plurality of strands (A) is formed of a plurality of reinforcing fibers (A) that are primarily twisted. The plurality of strands (A) is finally twisted in the core strand. Each of the plurality of strands (B) is formed of a plurality of reinforcing fibers (B) that are primarily twisted. The plurality of strands (B) is finally twisted to be disposed around the core strand. The direction of final twist of the plurality of strands (B) is the same as the direction of primary twist in at least one strand (B) selected from the plurality of strands (B). Further, in a first reinforcing cord of the present invention, the number of primary twists in the strand (B) is greater than the number of primary twists in the strand (A), and/or the number of final twists of the strands (B) is greater than the number of final twists of the strands (A).

Studies by the inventors of the present invention revealed that the shear force that acts on the adhesive layer (for example, RFL layer) to initiate destruction of the cord when it is bent will, in many cases, be maximum at the boundaries of the primary twist threads making up the outermost layer of the cord. This may indicate that the stress generating inside the core is in fact not a dominant factor of cord destruction. It follows from this that the shear force that causes breakage of the cord can be made smaller by such a cord construction that would minimize the shear force acting between the primary twist threads making up the outermost layer of the cord.

According to a configuration of a cord for rubber reinforcement of the present invention, the shear force acting between the primary twist threads making up the outermost layer of the cord can be reduced to realize a cord for rubber reinforcement that is less susceptible to damage due to bending fatigue. The present invention therefore can extend cord life in environments where bending fatigue occurs. Further, the present invention can suppress deterioration of tensile strength or stretching of the cord.

The reinforcing fibers (A) forming the core strand may be, for example, a glass fiber, a carbon fiber, an aramid fiber such as a polyparaphenylene benzobisoxazole fiber (PBO fiber), a nylon fiber, or a steel fiber. The reinforcing fibers (B) forming the strands (B) may be, for example, a glass fiber, a carbon fiber, an aramid fiber such as a PBO fiber, a nylon fiber, or a steel fiber. Examples of the glass fiber include E-glass fiber, K-glass fiber, U-glass fiber, S-glass fiber, R-glass fiber, and T-glass fiber. The glass fiber generally is made up of multiple filaments.

The reinforcing fibers (A) and the reinforcing fibers (B) may be the same or different as long as the effects of the present invention are obtained. Various combinations of the reinforcing fibers (A) and the reinforcing fibers (B) are possible. Preferable examples of reinforcing fiber (A)/reinforcing fiber (B) include E-glass fiber/E-glass fiber, PBO fiber/E-glass fiber, carbon fiber/E-glass fiber, PBO fiber/U-glass fiber, and K-glass fiber/K-glass fiber, among others.

Generally, the core strand is formed of 1 to 12 (for example, 1 to 3) strands (A). The strands (A) are finally twisted to form the core strand.

The number of primary twists in the strand (A) is generally 0.1 times/25 mm to 10 times/25 mm, for example, 0.5 times/25 mm to 6.0 times/25 mm. The direction of primary twist in the strands (A) may be either S direction or Z direction, as long as a configuration of the present invention is satisfied.

The number of final twists of the strands (A) is generally 0.1 times/25 mm to 10 times/25 mm, for example, 0.5 times/25 mm to 6.0 times/25 mm.

The peripheral strands around the core strand are generally formed of 5 to 24 (for example, 6 to 15) strands (B). The strands (B) are finally twisted to form the peripheral strands around the core strand.

A cord for rubber reinforcement of the present invention may include even numbers of (for example, 6, 8, 16) strands (B). In this case, strands (B) in which the direction of primary twist is S direction and strands (B) in which the direction of primary twist is Z direction alternately may be disposed around the core strands.

The number of primary twists in the strand (B) is generally 0.1 times/25 mm to 10 times/25 mm, for example, 0.5 times/25 mm to 6.0 times/25 mm. The direction of primary twist in the strands (B) may be either S direction or Z direction, or a combination of S- and Z-strands may be used, as long as a configuration of the present invention is satisfied.

The number of final twists of the strands (B) is generally 0.1 times/25 mm to 10 times/25 mm, for example, 0.5 times/25 mm to 6.0 times/25 mm. The direction of final twist of the strands (B) may be the same as or different from the direction of twist of the strands (A). When the direction of final twist of the strands (B) is the same as the direction of primary twist in at least one of the strands (B), a cord for rubber reinforcement with excellent bending fatigue resistance can be obtained.

The strands (A) and the strands (B) may be combined in such numbers that, for example, strands (A)/strands (B)=3/8, 3/12, 12/15, 3/9, 7/12, 7/11, or 12/14, among others.

When the number of primary twists in the strand (B) is greater than the number of primary twists in the strand (A), the number of primary twists in the strand (B) exceeds the number of primary twists in the strand (A) by a factor of 1.1 to 100 (for example, 2 to 12). When the number of final twists of the strand (B) is greater than the number of final twists of the strand (A), the number of final twists of the strands (B) exceeds the number of final twists of the strands (A) by a factor of 1.1 to 100 (for example, 1.5 to 12).

[Second Cord for Rubber Reinforcement]

A second reinforcing cord of the present invention for rubber reinforcement includes a single core fiber (a) and a plurality of strands (b) disposed around the core fiber (a). The core fiber (a) is twisted. Each of the plurality of strands (b) is formed of a plurality of reinforcing fibers (b) that are primarily twisted. The plurality of strands (b) is finally twisted to be disposed around the core fiber (a). The direction of final twist of the plurality of strands (b) is the same as the direction of primary twist in at least one strand (b) selected from the plurality of strands (b). The number of primary twists in the strands (b) is greater than the number of twists of the core fiber (a).

As described above, this configuration reduces the shear force acting between the primary twist strands making up the outermost layer of the cord, thereby realizing a cord for rubber reinforcement that is less susceptible to damage due to bending fatigue. The present invention therefore can extend cord life in environments where bending fatigue occurs. Further, the present invention can suppress the deterioration of tensile strength and stretching of the cord.

The core fiber (a) may be, for example, a polyparaphenylene benzobisoxazole fiber (PBO fiber), a carbon fiber, or a glass fiber. Note that the core fiber (a) may be a single strand.

The construction of the strands (b) and the fibers forming the strands (b) are the same as those of the strands (B) of the first cord for rubber reinforcement. As such, no further explanation will be given in this regard.

The core fiber (a) and the reinforcing fibers (b) may be the same or different as long as the effects of the present invention are obtained. Various combinations of the core fiber (a) and the reinforcing fibers (b) are possible. Preferable examples of core fiber (a)/reinforcing fiber (b) include E-glass fiber/E-glass fiber, PBO fiber/E-glass fiber, carbon fiber/E-glass fiber, PBO fiber/U-glass fiber, K-glass fiber/K-glass fiber, among others.

The number of twists of the core fiber (a) is generally 0.1 times/25 mm to 10 times/25 mm, for example, 0.5 times/25 mm to 6.0 times/25 mm. The direction of twist of the core fiber (a) may be S direction or Z direction as long as a configuration of the present invention is satisfied.

The peripheral strands around the core fiber (a) generally are formed of 5 to 24 (for example, 6 to 15) strands (b). The strands (A) are finally twisted to form the peripheral strands around the core fiber (a).

A cord for rubber reinforcement of the present invention may include even numbers of (for example, 6, 8, 12, 16) strands (b). In this case, strands (b) in which the direction of primary twist is S direction and strands (b) in which the direction of primary twist is Z direction alternately may be disposed around the core fiber (a).

The number of primary strands in the strands (b) is generally 0.1 times/25 mm to 10 times/25 mm, for example, 0.5 times/25 mm to 6.0 times/25 mm. The direction of primary twist in the strands (b) may be S direction or Z direction as long as a configuration of the present invention is satisfied.

The number of final twists of the strands (b) is generally 0.1 times/25 mm to 10 times/25 mm, for example, 0.5 times/25 mm to 6.0 times/25 mm. The direction of final twist of the strands (b) may be the same as or different from the direction of twist of the core fiber (a). When the direction of final twist of the strands (b) is the same as the direction of primary twist in the strands (b), superior bending fatigue resistance can be obtained.

The number of primary twists in the strand (b) is greater than the number of twists of the core fiber (a), for example, by a factor of 1.1 to 100 (for example, 2 to 12).

In the first and second cords for rubber reinforcement, the reinforcing fibers, and the strands, may be bonded to one another with an adhesive or the like. As the adhesive, those commonly used for bonding the reinforcing fibers of a cord for rubber reinforcement can be used. For example, a mixture containing at least two selected from a group of materials such as a resorcinol-formaldehyde condensation product, isocyanate, block isocyanate, a latex, carbon black, a vulcanizing agent, and a vulcanization adjuvant can be used.

In the first and second cords for rubber reinforcement, a coating film (overcoat layer) may be formed on a surface of the cord for rubber reinforcement. The coating film effectively improves the adhesion between the cord for rubber reinforcement and the rubber matrix in which the cord is embedded. As the coating film, those commonly used for a cord for rubber reinforcement can be used. The coating film can be formed, for example, by applying a mixture containing chlorosulfonated polyethylene, isocyanate, carbon black, P-nitrosobenzene, xylene, toluene, and the like over the strands and drying it.

[Manufacturing Method of Cord for Rubber Reinforcement]

A cord for rubber reinforcement of the present invention can be manufactured by a common method. The strands also can be formed by a common method using reinforcing fibers. Twisting, and applying and drying of the adhesive or binder agent also can be performed by common methods.

[Rubber Product]

A reinforcing cord of the present invention is applicable to a wide range of rubber products. For example, a reinforcing cord of the present invention is particularly suitable for toothed belts, conveyor belts, V-belts, and tires. A cord for rubber reinforcement of the present invention reinforces the rubber product by being embedded in a rubber portion (rubber matrix) of the rubber product.

EXAMPLES

The following will describe the present invention in detail based on examples.

Example 1

Three glass fibers (each being a bundle of 200 filaments having an average diameter of 9 μm, E-glass composition) were aligned with one another. After applying an aqueous treatment liquid shown in Table 1, the glass fibers were dried for one minute in a drying furnace that had been set to 150° C. As a result, a glass fiber strand (1) with a coating layer was obtained for Example 1. Note that the "solid content" in Table 1 means the amount of component other than the solvent or dispersion medium.

TABLE 1

| Components | Content (solid content) |
|---|---|
| H-NBR (solid content 40 mass %)(*1) | 100 parts by mass |
| RF | 10 parts by mass |

(*1)ZETPOL LATEX, manufactured by JAPAN ZEON CORPORATION

RF: resorcinol-formaldehyde condensation product (resorcinol-formalin condensation product)

The glass fiber strands (1) were primarily twisted at a rate of 0.4 times/25 mm in Z direction to obtain a strand (A). Separately, the glass fiber strands (1) were primarily twisted at a rate of 3.0 times/25 mm in S direction to obtain a strand (B).

Three such strands (A) and eight such strands (B) were prepared. The strands (A) were laced through apertures 10*a* at a central portion of a guide 10, and the strands (B) were laced through apertures 10*b* at the periphery of the guide 10, as shown in FIG. 1. Using the guide 10, these strands were finally twisted at a rate of 2 times/25 mm in S direction. In this way, core strands and peripheral strands were formed with the final twist of 2 times/25 mm in S direction. The strands were connected individually to a tensioner and finally twisted under a certain tension. The proportion of the coating layer in the reinforcing cord was 20 mass %.

Example 2

Comparative Examples 1 to 5

Cords for rubber reinforcement (Example 2, Comparative Examples 1 to 5) were prepared as in Example 1 except for varying the number of primary twists, the number of final twists, and the direction of twist of the strands. The configurations of the respective cords are given in Table 3 below.

Example 3

Comparative Example 6

Glass fiber strands (1) were prepared as in Example 1. The glass fiber strands (1) were primarily twisted at a rate of 1.0 time/25 mm in Z direction to obtain a strand (A). Separately, the glass fiber strands (1) were primarily twisted at a rate of 2.0 times/25 mm in S direction or Z direction to obtain a strand (B).

In this manner, three strands (A), four strands (B) with the primary twist in S direction, and four strands (B) with the primary twist in Z direction were prepared.

These eleven strands were laced through the apertures of a guide similar to the guide 10 shown in FIG. 1. The four strands (B) with the primary twist in Z direction, and the four strands (B) with the primary twist in S direction were alternately laced through eight apertures 10*b*. All strands were finally twisted at a rate of 2.0 times/25 mm in S direction. In this manner, a cord for rubber reinforcement of Example 3 was obtained.

A reinforcing cord of Comparative Example 6 was obtained as with the reinforcing cord of Example 3, except that the primary twist in the strands (B) was in the Z direction. That is, the configurations of Example 3 and Comparative Example 6 are the same except for the direction of primary twist in the strands (B), as shown in Table 3.

An overcoat layer was formed on each of these reinforcing cords. The overcoat layer was formed by applying a mixture of chlorosulfonated polyethylene rubber (CSM rubber), isocyanate, p-nitrosobenzene, carbon black, and xylene, and then drying it.

Then, the dimensional stability of each reinforcing cord with the overcoat layer was evaluated. Specifically, the cord was stretched and a tension at 0.8% stretch was measured.

Separately, a flat belt was prepared using the reinforcing cord with the overcoat layer. Specifically, the reinforcing cord was embedded in a rubber matrix of the composition shown in Table 2, so as to prepare a flat belt (295 mm in length, 9 mm in width, 3 mm in thickness).

TABLE 2

| Component | Content (parts by mass) |
|---|---|
| H-NBR(*2) | 70 |
| H-NBR/ZDMA(*3) | 30 |
| ZnO | 10 |
| Stearic acid | 1 |
| Carbon black | 30 |
| Trioctyl trimellitate | 5 |
| Sulfur | 0.1 |
| 1,3-Bis-(t-butylperoxy-isopropyl)-benzene | 6 |

(*2)hydrogenated nitrile rubber (ZETPOL 2020, manufactured by JAPAN ZEON CORPORATION)
(*3)hydrogenated nitrile rubber with zinc dimethacrylate (ZDMA) dispersed therein (ZSC 2000L, manufactured by JAPAN ZEON CORPORATION)

Then, the bending resistance of the flat belt was evaluated. Specifically, the flat belt was subjected to a bending tester, and the number of bends that it took for the belt surface to crack was determined. This value was regarded as bend life. The bending test was performed under the following conditions. Pulley radius: 5 mm; tension: 10 N; frequency: 10 Hz.

Table 3 below shows the configurations of the strands in the cords for rubber reinforcement, along with the results of evaluation.

TABLE 3

| | | Ex. 1 | Ex. 2 | Com. Ex. 1 | Com. Ex. 2 | Com. Ex. 3 | Com. Ex. 4 | Com. Ex. 5 | Ex. 3 | Com. Ex. 6 |
|---|---|---|---|---|---|---|---|---|---|---|
| Core material | | E-glass | E-glass | E-glass | E-glass | E-glass | E-glass | E-glass | E-glass | E-glass |
| Number of strands (A) in core | | 3 | 3 | 3 | 3 | 3 | 3 | 3 | 3 | 3 |
| Direction of primary twist in strands (A) | | Z | Z | Z | Z | Z | S | S | Z | Z |
| Number of primary twists in strands (A) (t/25 mm) | | 0.4 | 2.0 | 2.0 | 4.0 | 2.0 | 2.0 | 4.0 | 1.0 | 1.0 |
| Direction of final twist of core | | S | S | S | S | S | S | S | S | S |
| Number of final twists of core (t/25 mm) | | 2.0 | 2.0 | 2.0 | 2.0 | 2.0 | 2.0 | 2.0 | 2.0 | 2.0 |
| Material of strands (B) | | E-glass | E-glass | E-glass | E-glass | E-glass | E-glass | E-glass | E-glass | E-glass |
| Number of peripheral strands | | 8 | 8 | 8 | 8 | 8 | 8 | 8 | 8 | 8 |
| Direction of primary twist in strands (B) | | S | S | S | S | Z | S | S | SZS ZSZ SZ | Z |
| Number of primary twists in strands (B) (t/25 mm) | | 3.0 | 4.0 | 2.0 | 4.0 | 2.0 | 2.0 | 4.0 | 2.0 | 2.0 |
| Direction of final twist of peripheral strands | | S | S | S | S | S | S | S | S | S |
| Number of final twists of peripheral strands (t/25 mm) | | 2.0 | 2.0 | 2.0 | 2.0 | 2.0 | 2.0 | 2.0 | 2.0 | 2.0 |
| Bend life ($\times 10^6$ times) | | 55 | 42 | 33 | 41 | 7 | 33 | 39 | 59 | 6 |
| Tension at 0.8% stretch (N) | | 225 | 193 | 198 | 186 | 196 | 190 | 183 | 200 | 199 |
| Evaluation | Bending fatigue resistance | Excellent | Excellent | Good | Excellent | Average | Good | Good | Excellent | Average |
| | Dimensional stability | Excellent | Good | Good | Average | Good | Good | Average | Good | Good |

In the evaluation of bending fatigue resistance, the bending fatigue resistance in Table 3 was denoted as "Excellent" when the bend life was $40\times10^6$ or greater, "Good" when $20\times10^6$ or greater and less than $40\times10^6$, and "Average" when less than $20\times10^6$. Further, in the evaluation of dimensional stability, the dimensional stability in Table 3 was denoted as "Excellent" when the measurement result was 210 N or greater, "Good" when 190 N to 209 N, and "Average" when less than 190 N.

As shown in Table 3, a cord satisfying both bending fatigue resistance and dimensional stability was obtained by increasing the number of primary twists in the peripheral strands (B) more than in the strands (A) of the core.

Further, in Example 3, by the alternate arrangement of the strands (B) with the primary twist in S direction and Z direction, the shear force between the strands (B) was minimized and the bending fatigue resistance was significantly improved compared with Comparative Example 1. Further, it can be seen that the cord of Example 3, by the alternate arrangement of the strands (B) with the primary twist in S direction and Z direction, has superior bending fatigue resistance compared with the cord of Comparative Example 6, which differs only in the arrangement of the strands (B).

Example 4

Glass fiber strands (1) were prepared, as in Example 1. The glass fiber strands (1) were primarily twisted at a rate of 2.0 times/25 mm in S direction to obtain a strand (A). Separately, the glass fiber strands (1) were primarily twisted at a rate of 2.0 times/25 mm in S direction to obtain a strand (B).

Three such strands (A) were finally twisted at a rate of 5.0 times/25 mm in Z direction. These three strands (A) and eight strands (B) then were finally twisted together at a rate of 3.0 times/25 mm in S direction. As a result, a reinforcing cord of Example 4-1 was obtained. In the end, the core strands of the cord had a final twist of 2.0 times/25 mm in Z direction.

In Example 4-1, a guide having a single aperture 10*a* at a central portion and having the same peripheral apertures 10*b* as those of the guide 10 was used instead of the guide 10 shown in FIG. 1. Using this guide, the three strands (A) were laced through the central aperture 10*a*, and the strands (B) were laced through the peripheral apertures 10*b*. The guide used in Example 4-1 also was used in Example 4-2, Examples 5 and 6, and Comparative Examples 7 to 11 to prepare cords.

In Example 4-2, strands (B) with the primary twist in S direction, and strands (B) with the primary twist in Z direction were alternately positioned for final twisting.

In Example 4-3, strands (A) and strands (B) were prepared as in Example 1, and these strands were finally twisted as in Example 4-1. That is, in Example 4-3, a cord was prepared in which the strands (B) exceeded the strands (A) both in the number of primary twists and the number of final twists.

Comparative Examples 7 to 9

Cords for rubber reinforcement of Comparative Examples 7 to 9 were prepared as in the foregoing Examples and Comparative Examples. An overcoat layer was formed on each of the reinforcing cords, which were then evaluated as in Example 1. Table 4 below show the configurations of the cords for rubber reinforcement of Examples 4-1, 4-2, and Comparative Examples 7 to 9, along with the results of evaluation.

TABLE 4

| | | Ex. 4-1 | Com. Ex. 7 | Com. Ex. 8 | Com. Ex. 9 | Ex. 4-2 | Ex. 4-3 |
|---|---|---|---|---|---|---|---|
| Core material | | E-glass | E-glass | E-glass | E-glass | E-glass | E-glass |
| Number of strands (A) in core | | 3 | 3 | 3 | 3 | 3 | 3 |
| Direction of primary twist in strands (A) | | S | S | S | S | S | Z |
| Number of primary twists in strands (A) (t/25 mm) | | 2.0 | 2.0 | 2.0 | 2.0 | 2.0 | 0.4 |
| Direction of final twist of core | | Z | Z | Z | Z | Z | S |
| Number of final twists of core (t/25 mm) | | 2.0 | 2.0 | 2.0 | 3.0 | 2.0 | 2.0 |
| Material of strands (B) | | E-glass | E-glass | E-glass | E-glass | E-glass | Eglass |
| Number of peripheral strands | | 8 | 8 | 8 | 8 | 8 | 8 |
| Direction of primary twist in strands (B) | | S | S | S | S | SZSZS ZSZ | S |
| Number of primary twists in strands (B) (t/25 mm) | | 2.0 | 2.0 | 2.0 | 2.0 | 2.0 | 3.0 |
| Direction of final twist of peripheral strands | | S | Z | S | S | S | S |
| Number of final twists of peripheral strands (t/25 mm) | | 3.0 | 3.0 | 2.0 | 3.0 | 3.0 | 3.0 |
| Bend life ($\times10^6$ times) | | 47 | 36 | 6 | 48 | 63 | 61 |
| Tension at 0.8% stretch (N) | | 192 | 194 | 198 | 175 | 193 | 205 |
| Evaluation | Bending fatigue resistance | Excellent | Good | Average | Excellent | Excellent | Excellent |
| | Dimensional stability | Good | Good | Good | Average | Good | Good |

In the evaluation of bending fatigue resistance, the bending fatigue resistance in Table 4 was denoted as "Excellent" when the bend life was $40\times10^6$ or greater, "Good" when $20\times10^6$ or greater and less than $40\times10^6$, and "Average" when less than $20\times10^6$. Further, in the evaluation of dimensional stability, the dimensional stability in Table 4 was denoted as "Excellent" when the measurement result was 210 N or greater, "Good" when 190 N to 209 N, and "Average" when less than 190 N.

Unlike Comparative Examples 8 and 9, the number of final twists of the peripheral strands is greater than that of the core in Examples 4-1 and 4-2. This configuration improved the bending fatigue resistance. Further, because the direction of final twist and the direction of primary twist were different in the strands (B) of Comparative Example 7, the bend life was shorter in Comparative Example 7 than in Examples 4-1 and 4-2.

In Example 4-2, because of the alternate arrangement of the strands (B) with the primary twist in S direction and Z direction, the shear force between the strands (B) was minimized. This further improved the bending fatigue resistance over Example 4-1.

The cords of Examples 4-1 and 4-2 are cords for rubber reinforcement including a core strand having a plurality of strands (A), and a plurality of strands (B) disposed around the core strands. In these cords, each strand (A) is formed of a plurality of reinforcing fibers (A) that are primarily twisted, and a plurality of strands (A) is finally twisted in the core strand. Each strand (B) is formed of a plurality of reinforcing fibers (B) that are primarily twisted, and a plurality of strands (B) is finally twisted to be disposed around the core strand. The number of final twists of the strands (B) is greater than the number of final twists of the strands (A). The direction of final twist of the strands (B) is the same as the direction of primary twist in at least one strand (B) selected from the plurality of strands (B).

In these cords, strands (B) with the primary twist in S direction and strands (B) with the primary twist in Z direction may be alternately disposed around the core strands.

Similar effects can be obtained when the number of final twists and the number of primary twists are greater in the strands (B) than in the strands (A), as in Example 4-3.

Examples 5, 6

Comparative Examples 10, 11

As a core fiber (a), a single-stranded PBO fiber (TOYOBO CO., LTD., untwisted, 160 TEX) was prepared. Further, as in Example 3, strands (b) with the primary twist in S direction, and strands (b) with the primary twist in Z direction were prepared. These strands were finally twisted together to prepare a cord for rubber reinforcement. As in Example 1, an overcoat layer was formed on each reinforcing cord so obtained, and evaluation was made as in Example 1. Table 5 shows the configurations of the cords for rubber reinforcement of Examples 5 and 6, and Comparative Examples 10 and 11, along with the results of evaluation. The core fiber (a) of Example 5 first was twisted at a rate of 3.0 times/25 mm in Z direction, followed by twisting (final twisting) with the peripheral strands at a rate of 2.0 times/25 mm in S direction. In the end, the core fiber (a) had a twist of 1.0 time/25 mm in Z direction. The core fiber (a) of Example 6 first was twisted at a rate of 1.0 time/25 mm in Z direction, followed by twisting (final twisting) with the peripheral strands at a rate of 2.0 times/25 mm in S direction. In the end, the core fiber (a) had a twist of 1.0 time/25 mm in S direction. The cord for rubber reinforcement of Comparative Example 10 was prepared as in Example 6 except for the alteration of the primary twist directions of the strands (b). The core fiber (a) of Comparative Example 9 was twisted with the peripheral strands at a rate of 2.0 times/25 mm (final twisting), without being twisted first. In the end, the core fiber (a) had a twist of 2.0 times/25 mm in S direction.

TABLE 5

| | | Ex. 5 | Ex. 6 | Com. Ex. 10 | Com. Ex. 11 |
|---|---|---|---|---|---|
| Core material | | PBO fiber | PBO fiber | PBO fiber | PBO fiber |
| Number of core fiber (a) | | 1 | 1 | 1 | 1 |
| Direction of twist of core fiber (a) | | Z | S | S | S |
| Number of primary twists of core fiber (a) (t/25 mm) | | 1.0 | 1.0 | 1.0 | 2.0 |
| Material of strands (b) | | E-glass | E-glass | E-glass | E-glass |
| Number of peripheral strands | | 6 | 6 | 6 | 6 |
| Direction of primary twist in strands (b) | | S | SZSZSZ | Z | S |
| Number of primary twists in strands (b) (t/25 mm) | | 2.0 | 2.0 | 2.0 | 2.0 |
| Direction of final twist of peripheral strands | | S | S | S | S |
| Number of final twists of peripheral strands (t/25 mm) | | 2.0 | 2.0 | 2.0 | 2.0 |
| Bend life ($\times10^6$ times) | | 34 | 55 | 20 | 34 |
| Tension at 0.8% stretch (N) | | 154 | 156 | 153 | 142 |
| Evaluation | Bending fatigue resistance | Good | Excellent | Good | Good |
| | Dimensional stability | Excellent | Excellent | Excellent | Good |

In the evaluation of bending fatigue resistance, the bending fatigue resistance in Table 5 was denoted as "Excellent" when the bend life was $40\times10^6$ or greater, "Good" when $20\times10^6$ or greater and less than $40\times10^6$, and "Average" when less than $20\times10^6$. Further, in the evaluation of dimensional stability, the dimensional stability in Table 5 was denoted as "Excellent" when the measurement result was 150 N or greater, and "Good" when 140 N to 149 N.

In Examples 5 and 6, the number of primary twists in the strands (b) is greater than the number of twists of the core. In Example 5, the direction of final twist of the strands (b) is the same as the direction of primary twist in the strands (b). Example 5 had better dimensional stability than Comparative Example 11.

In Example 6, by the alternate arrangement of the strands (b) with the primary twist in S direction and Z direction, the shear force between the strands (b) was minimized and the bending fatigue resistance was improved. This can be confirmed by comparison with Comparative Example 10 that differed from Example 6 only in the arrangement of the strands (b).

In many cases, the shear force that acts on the adhesive layer (RFL layer) to initiate breakage of the cord due to bending occurs at the boundaries of the primarily twisted fibers in the peripheral strands. By forming only the peripheral strands in Lang's lay, or increasing the number of twists of the peripheral strands, the stress generated inside the cord at the time of bending can be reduced to extend cord life.

Industrial Applicability

The present invention is applicable to cords for rubber reinforcement.

The invention claimed is:

1. A cord for rubber reinforcement, comprising: a core strand including a plurality of strands (A); and a plurality of strands (B) disposed around the core strand, each of the plurality of strands (A) being formed of a plurality of reinforcing fibers (A) that are primarily twisted, the plurality of strands (A) being finally twisted in the core strand, each of the plurality of strands (B) being formed of a plurality of reinforcing fibers (B) that are primarily twisted, the plurality of strands (B) being finally twisted to be disposed around the core strand, (i) the direction of final twist of the plurality of strands (B) being the same as the direction of primary twist in at least one strand (B) selected from the plurality of strands (B), and the number of primary twists in the strand (B) being greater than the number of primary twists in the strand (A), and/or (ii) the direction of final twist of the plurality of strands (B) being the same as the direction of primary twist in at least one strand (B) selected from the plurality of strands (B), and the number of final twists of the strands (B) being greater than the number of final twists of the strands (A).

2. The cord for rubber reinforcement according to claim 1, wherein the cord comprises even numbers of the strands (B), including strands with a primary twist in an S direction and strands with a primary twist in a Z direction, and wherein the strands with a primary twist in the S direction and the strands with a primary twist in the Z direction are alternately disposed around the core strand.

3. A cord for rubber reinforcement, comprising: a single core fiber (a); and even numbers of the strands (b) disposed around the core fiber (a), the core fiber (a) being twisted, each of the even numbers of the strands (b) being formed of a plurality of reinforcing fibers (b) that are primarily twisted, the even numbers of the strands (b) being finally twisted to be disposed around the core fiber (a), the direction of final twist of the even numbers of the strands (b) being the same as the direction of primary twist in at least one strand (b) selected from the even numbers of the strands (b), the number of primary twists in the strands (b) being greater than the number of twists of the core fiber (a), and the strands (b) including strands with a primary twist in an S direction and strands with a primary twist in a Z direction, the strands with a primary twist in the S direction and the strands with a primarily twist in the Z direction being alternately disposed around the core fiber (a).

* * * * *